US005505889A

United States Patent [19]

Davies

[11] Patent Number: 5,505,889

[45] Date of Patent: Apr. 9, 1996

[54] METHOD OF SPINNING BICOMPONENT FILAMENTS

[75] Inventor: Barrie L. Davies, Weddington, N.C.

[73] Assignee: Hoechst Celanese Corporation, Somerville, N.J.

[21] Appl. No.: 91,704

[22] Filed: Jul. 14, 1993

Related U.S. Application Data

[62] Division of Ser. No. 895,412, Jun. 5, 1992, Pat. No. 5,256,050, which is a continuation of Ser. No. 454,217, Dec. 21, 1989, abandoned.

[51] Int. Cl.[6] ..... D01F 8/04

[52] U.S. Cl. ..... 264/173.16; 264/DIG. 26

[58] Field of Search ..... 264/171, 177.13, 264/DIG. 26; 425/131.5, 463, DIG. 217

[56] References Cited

U.S. PATENT DOCUMENTS

| | | | |
|---|---|---|---|
| 2,861,319 | 11/1958 | Breen | 264/171 X |
| 2,989,798 | 6/1961 | Bannerman | 264/171 X |
| 3,038,235 | 6/1962 | Zimmerman | 264/171 X |
| 3,117,362 | 1/1964 | Breen | 264/171 X |
| 3,188,689 | 6/1965 | Breen | 425/463 |
| 3,992,499 | 11/1976 | Lee | 264/171 X |
| 4,251,200 | 2/1981 | Parkin | 425/131.5 |
| 4,406,850 | 9/1983 | Hills | 264/171 |
| 5,162,074 | 11/1992 | Hills | 264/171 X |

*Primary Examiner*—Leo B. Tentoni
*Attorney, Agent, or Firm*—Philip P. McCann

[57] ABSTRACT

A method of melt spinning sheath/core bicomponent fibers including the steps of passing multiple streams of pressurized molten core polymer from distributor flow passages into multiple parallel spinneret flow passages in respective axial or coaxial alignment with said multiple distributor flow passages. In pressured molten sheath polymer is passed through channels positioned in the top surface of the spinneret and surrounding the inlets of the spinneret flow passages. The sheath polymer is directed to flow from the channels into each of the spinneret flow passages and each of the polymer streams at a controlled pressure drop.

4 Claims, 2 Drawing Sheets

Fig 3
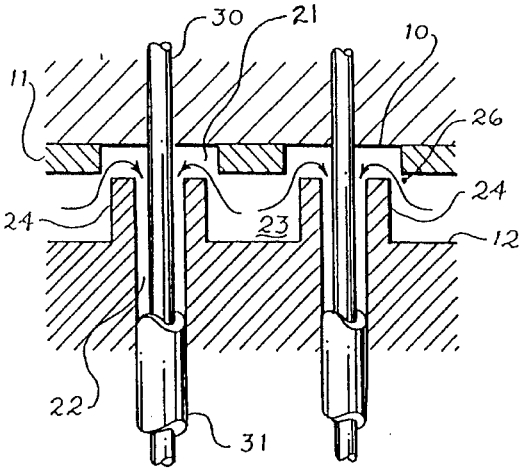
Fig 4
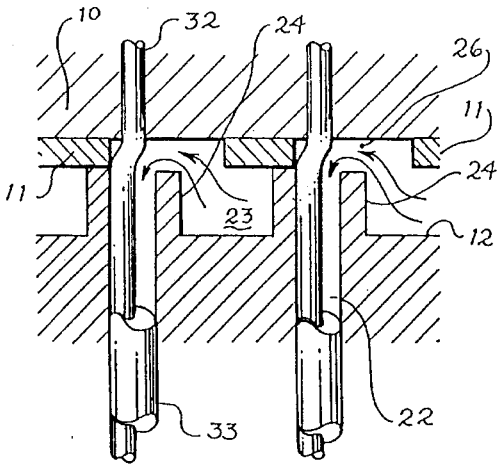
Fig 3a
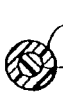
Fig. 3b
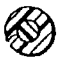
Fig 4a
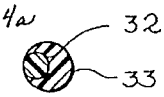
Fig 4b
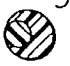
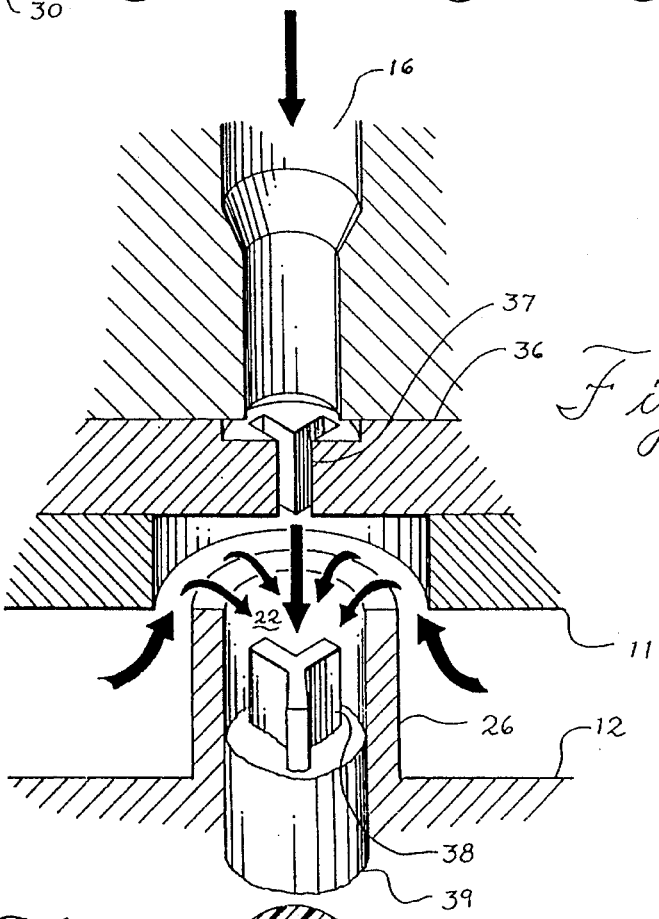
Fig. 5
Fig 5a
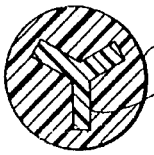

METHOD OF SPINNING BICOMPONENT FILAMENTS

The present application is a division of application Ser. No. 07/895,412 filed Jun. 5, 1992 which has issued into U.S. Pat. No. 5,256,050, which is a continuation of Ser. No. 07/454,217 filed Dec. 21, 1989, now abandoned.

This invention relates to a method and apparatus for spinning bicomponent filaments and the improved products produced therefrom. Further, this invention relates to a method and apparatus for spinning improved bicomponent filaments in concentric or eccentric sheath/core relationships.

Background

Bicomponent filaments of the sheath/core configuration are well known and a variety of spinning packs and spinnerets have been employed in the production of such filaments. A conventional spinning assembly involves feeding the sheath-forming material to the spinneret orifices in a direction perpendicular to the orifices, and injecting the core-forming material into the sheath-forming material as it flows into the spinneret orifices.

A bicomponent spinning assembly is disclosed in U.S. Pat. No. 4,406,850 whereby molten sheath polymer is issued in ribbon flow into recessed slot-like portions of the top surface of the spinneret positioned between rows of raised spinneret core inlets. U.S. Pat. No. 4,251,200 also discloses a bicomponent spinning assembly comprising a spinneret plate and a distribution plate spaced apart, the distributor plate having an aperture opposite each orifice in the spinneret plate and a plateau-like protrusion extending about the axis common to aperture and the extrusion orifice. Additionally, the assembly includes an orifice plate for restricting the entrance to the orifice.

The concentricity of the core and sheath capillaries in the prior art spinning assemblies as described above and in other spinning assemblies is not satisfactory. It is difficult to properly position the distributor plate and the spinneret of the prior art assemblies so that proper alignment of the distributor and flow passages and pressure drop control are obtained so as to produce sheath/core bicomponent fibers of uniform cross section.

Typical of spinning assemblies of the prior art as exemplified by the cited references, the gap between the exit surface of the distributor and the inlet surface of the spinneret is fixed. Thus, if the sheath polymer viscosity varies or the core/sheath ratio changes, the pressure drop control in the prior art assemblies is lost. It is necessary to control sheath polymer pressure drop adjacent the spinneret inlet as will be hereafter discussed to obtain bicomponent fibers consistent from filament to filament.

Further, in those spinning assemblies where the annular gap between the distributor and spinneret is fixed, polymer pressure is sufficient at times to bow the spinneret away from the distributor thereby opening up the gap and changing the pressure drop. The exit and inlet passages of the distributor and spinneret, respectively, nearest the center and the source of the sheath polymer will have the widest gaps and those farthest from the center will have the narrowest gap. Sheath polymer will flow preferentially to the inner passages providing poor bicomponent filament uniformity.

Invention

By the invention there is provided an improved process and apparatus for the production of improved, bicomponent sheath/core filaments of uniform cross section whereby the spinning pack assembly can be readily adjusted to compensate for changes in sheath polymer viscosity and changes in polymer flux and the sheath polymer flow to each spinneret core polymer flow passage can be controlled separately.

BRIEF DESCRIPTION OF THE DRAWINGS

FIG. 3 is a vertical section of a distributor/shim/spinneret assembly to produce concentric bicomponent filaments.

FIG. 3*a* and 3*b* illustrate the concentric cross-section of the bicomponent filament.

FIG. 4 is a vertical section of a distributor/shim/spinneret assembly to produce eccentric bicomponent filaments.

FIGS. 4*a* and 4*b* illustrate the eccentric cross-section of the bicomponent filament.

FIG. 5 is a vertical section of a distributor/shim/spinneret assembly to produce bicomponent filaments of non-circular cross-section.

FIG. 5*a* illustrates the Y-shaped cross-section.

DESCRIPTION OF PREFERRED EMBODIMENTS

Figure 1:
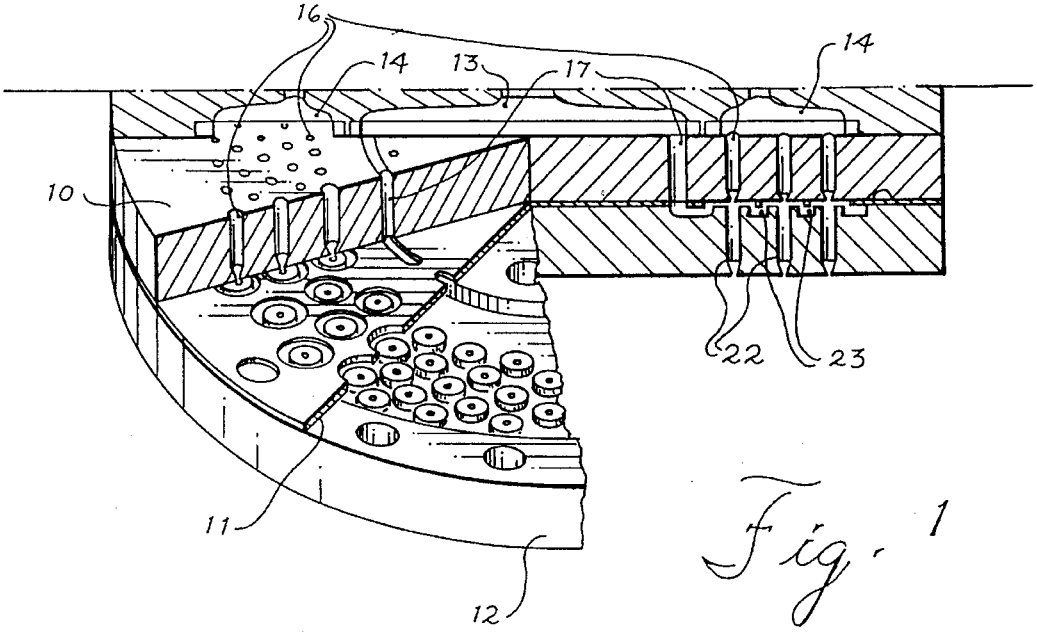
FIG. 1 is a view in perspective of a spin pack assembly embodiment of the invention.

Referring to the accompanying drawings and more specifically to FIG. 1, a bicomponent filament spin pack assembly can be fabricated from a distributor 10, a shim 11 and a spinneret 12. Distributor 10 is positioned so as to receive a melt-extruded sheath polymer or a sheath polymer in solution through a channel 13 and a melt-extruded core polymer or core polymer in solution through channel 14. Each of the sheath and core polymers are passed to the respective channels 13 and 14 by conventional melt extrusion, pump and filter means not herein illustrated.

The distributor 10 functions to form the core polymer into filaments and to channel the flow of sheath polymer to spinneret 12. The core polymer is pumped through multiple passages 16 to the lower, even surface of distributor 10. Passages 16 can be arranged in any number of rows or columns depending upon their size, the viscosity of the core polymer, the length of passages 16 and the flow characteristics of the particular core polymer. The bottom of each passage 16 is tapered to provide a core filament of the desired diameter. Although not to be limited thereto, the density of passages 16 in distributor 10 when, for example, the core polymer is melted polyethylene terephthalate and the exit passage diameter is in the range from 0.1 millimeter (mm) to 1.0 mm, can be such that each passage utilizes 10 square mm of the spinneret area.

Sheath polymer flowing through channel 13 is pumped to passages 17 and through passages 17 to spinneret 12. Although not to be limited thereto, the passages 17 are preferably axially positioned in distributor 10 so that upon exiting passages 17 the sheath polymer will flow radially outwardly toward the inlets of passages 22.

Figure 2:
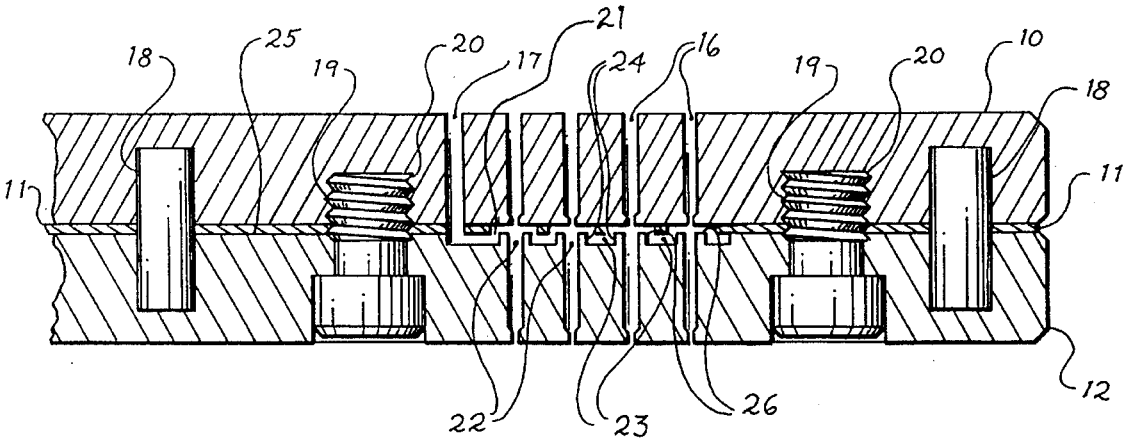
FIG. 2 is a vertical section of a multiple passage distributor/shim/spinneret assembly.

A shim 11 is positioned between distributor 10 and spinneret 12 and maintained in fixed relationship to distributor 10 and spinneret 12 by bolts 19 engaging threaded recesses 20 in distributor 10. Distributor 10 and spinneret 12 are relatively positioned by dowel pins 18. In order to overcome bowing and separation of distributor 10 and spinneret 12 which can occur in the operation of conventional spin pack assemblies, a ring of bolts 19 has been positioned in the center of the assembly as shown in FIG. 2. The shim can be fabricated from a variety of materials such as stainless steel or brass with stainless steel being preferred. The shim can be constructed as a single unit or in two separate inner and outer pieces. The number and positioning of bolts 19 is such as to control deflection, preferably limiting deflection to less than 0.002 mm.

Shim 11 must be of substantially constant thickness, preferably having a variance in thickness of less than 0.002 mm and the circular openings 21 must be in proper alignment with distributor passages 16 and spinneret passages 22. Shims 11 of different thicknesses, normally ranging from 0.025 to 0.50 mm, are employed to adjust for changes in sheath polymer viscosity, changes in polymer flux or to change the pressure drop as will be hereafter discussed.

The top smooth, even surface of the spinneret 12 is recessed, providing a channel 23 for the flow of sheath polymer to each passage 22. Raised circular portions or buttons 24 surround each passage 22. The raised portions or buttons 24 project upwardly from channel 23 to a height which is equal to the top surface 25 of spinneret 12. The rate of outward flow of sheath polymer through channel 23 and over the buttons 24 to passages 22 is a result of the pressure drop determined by the thickness of shim 11. The pressure drop is inversely proportioned to the third power of the height of the gap 26 between distributor 10 and spinneret 12. Close control of this gap height is effected by shim 11 and maintained by the inner circle of bolts 19. The recess depth of channel 23 is selected so as to provide a low pressure drop (normally 20–50 psi) radially across the top of the spinneret. The shim thickness is selected to normally provide a 100–1000 psi pressure drop across the raised buttons 24.

As will be evident from the drawings, each passage 22 must be in concentric alignment with its corresponding passage 16. The core polymer flows through passages 16 and passages 22, exiting spinneret 12 as the core of a bicomponent fiber. The sheath polymer flows through passages 17, channel 23 and gap 26 to form a sheath about the filament of core polymer producing the aforementioned bicomponent fiber. The center axis of distributor passage 16 should be within a circle having a radius less than 200 microns, preferably less than 50 microns from the center axis of the spinneret counterbore.

The production of concentric bicomponent fibers is further illustrated in FIG. 3. Shim 11 is positioned to cause sheath polymer 31 flowing through channel 23, over buttons 24, and through gap 26 into channel 22, forming a concentric sheath about core polymer 30 as shown. The concentric cross-section of the formed bicomponent filament is illustrated in FIGS. 3*a* and 3*b*.

The production of eccentric sheath/core fibers is illustrated in FIG. 4. The holes in shim 11 are positioned so as to restrict the flow of sheath polymer 33 in the manner illustrated. The eccentric cross section of the formed bicomponent filament is also illustrated in FIGS. 4*a* and 4*b*.

FIG. 5 illustrates a spinneret assembly employed to produce sheath/core bicomponent fibers wherein the core has a non-circular cross section. As shown, the core polymer passes through passage 16 of distributor to a core profile shim 36 containing a passage 37 having a Y-shaped cross section. The core polymer flows through core profile shim 36 to passage 22 in the manner previously described. The sheath polymer is transmitted to passage 22 in the previously described manner and a bicomponent fiber having a sheath 39 and core 38 is produced as illustrated in FIG. 5*a*.

The bicomponent sheath/core filaments produced by the spinneret assembly of the invention are of uniform cross section from filament to filament. The core and sheath of each filament will have substantially the same cross sectional shape and area. Preferably, the diameter coefficient of variability for the bicomponent fibers of this invention will be less than 2.50% based upon diameter measurements of at least twenty-five simultaneously produced filaments. The coefficient of variability (CV) is determined by:

$$CV = \frac{\text{Standard deviation of the filament diameter}}{\text{Mean filament diameter}} \times 100$$

The eccentricity coefficient of variability for twenty-five simultaneously produced concentric bicomponent filaments of the invention will preferably be less than 1.0%. The eccentricity coefficient variability (ECV) is determined by the following relationship:

$$ECV = \frac{\text{Displacement of core center}}{\text{Bicomponent filamenter diameter}} \times 100$$

Normally, the diameter coefficient of variability for commercially produced sheath/core bicomponent filaments will exceed 4.5% and the eccentricity coefficient of variability for concentric sheath/core bicomponent filaments will exceed 6.00%.

The invention will hereafter be described as it relates to the production of sheath/core bicomponent fibers wherein the sheath polymer comprises a melted polyethylene blend as hereafter described and the core polymer comprises a melted polyethylene terephthalate although it will be understood by those skilled in the art that other sheath and core polymers could be employed.

A maleic anhydride grafted high density polyethylene was prepared in accordance with the procedure of U.S. Pat. No. 4,684,576, the disclosure of such patent being incorporated herein by reference thereto. The high density polyethylene resin had a melt flow value (MFV) of 25 g/10 min. at 190° C. [ASTMD—1238(E)] and a density of 0.955 g/cc (ASTM D 792) before extrusion. After extrusion its MFV measured 15 g/10 min. This product was blended with a linear low density polyethylene resin having an MFV of 18 g/10 min. at 190° C. such that the maleic anhydride content of the blend was between 0.09–0.12 weight percent. The polymer blend hereafter employed as the sheath polymer in the following examples had an MFV of 16 g/10 min. at 190° C. and a density of 0.932 g/cc. The core polymer of the following examples was a polyethylene terephthalate having an intrinsic viscosity (ASTM D 2857) of 0.645.

EXAMPLE I

The spinneret assembly of FIG. 1 having spinneret hole diameters of 0.374 mm was used to spin concentric bicomponent sheath/core filaments with core sheath ratios of 60:40 (Run 1), 70:30 (Run 2) and 80:20 (Run 3) weight percent. The melted sheath polymer was passed to passages 17 at a temperature of 275° C. The melted core polymer was passed to passages 16 at a temperature of 275° C. The throughput per spinneret hole was 0.852, 0.903 and 0.935 g/min, respectively.

The bicomponent filaments were quenched with 30° C. air and wound up at a speed of 2800 fpm. The resulting filaments were then drawn at a draw ratio of 3.0 at 60° C. and crimped in a conventional stuffer box. After drawing and heat setting at 90° C., the filaments were cut to 1.5 inch fiber lengths and the properties are shown below in Table I.

TABLE I

| RUN | DENIER PER FILAMENT (DPF) (ASTM - D-2101-82) | TENACITY (ASTM - D-2101-82) | % ELONG. (ASTM - D-2101-82) | STRESS AT SPECIFIED ELONGATION (10%) (ASTM - D-2102-82) | CRIMPS PER INCH (CPI) (ASTM - D-3937-82) | TOUGHNESS (ASTM - D-2101-82) | % CRIMP (ASTM - D-3937-82) |
|---|---|---|---|---|---|---|---|
| 1 | 3.14 | 4.15 | 41 | 1.1 | 14.0 | 26.6 | 26.5 |
| 2 | 3.79 | 3.68 | 54 | 0.8 | 11.4 | 27.0 | 28.5 |
| 3 | 3.95 | 3.60 | 65 | 0.8 | 13.9 | 28.8 | 25.5 |

The spinneret assembly of the invention can be employed to produce solution spun bicomponent filaments. By adjusting the pack dimensions and polymer solution viscosities, bicomponent filaments from, for example, cellulose acetate and viscose could be produced.

The principles, preferred embodiments and modes of operation of the present invention have been described in the foregoing specification. The invention which is intended to be protected herein, however, is not to be construed as limited to the particular forms disclosed since those are to be regarded as illustrative rather than restrictive. Variations and changes may be made by those skilled in the art without departing from the spirit of the invention.

I claim:

1. A method of making sheath/core bicomponent filaments using a filament spinneret assembly having a distributor spaced core polymer passages and sheath polymer flow passages and a spinneret having spaced spinneret passages, each of said spinneret passages in coaxial alignment with the outlet of a respective core polymer passage, a plurality of recessed sheath channels, and raised buttons surrounding each spaced spinneret passage and located between the spaced spinneret passage and the sheath channels wherein each button has a flat top face, wherein the method comprises the steps of (1) supplying a pressurized core polymer to the spaced core polymer passages wherein the core polymer flows into the corresponding spinneret passage; and (2) supplying a pressurized sheath polymer to the inlet of said sheath polymer flow passage, wherein the flow of the sheath polymer around the core polymer at the spinneret passage is controlled by a shim means positioned between said spinneret and said distributor for forming a gap having a height between the top face side of each button of the spinneret and said distributor at each spinneret passage whereby the thickness of the shim determines the height of said gap and effects a controlled pressure drop of the sheath polymer flow through the gap between the top face of each button in the distributor to the inlet of each said spinneret passage separately, wherein said shim means has a shim thickness of less than 0.5 mm.

2. The method of claim 1 wherein said sheath polymer is caused to flow radially outwardly through said channels to each of said spinneret passage inlets.

3. The method of claim 1 wherein each of the bicomponent fibers exiting said spinneret is a concentric sheath/core filament.

4. The method of claim 1 wherein each of the bicomponent fibers exiting said spinneret is an eccentric sheath/core filament.

* * * * *